US005400868A

United States Patent [19]

Ellis et al.

[11] Patent Number: 5,400,868

[45] Date of Patent: Mar. 28, 1995

[54] SHOCK INDICATOR FOR USE ON SAFETY CABLES

[75] Inventors: J. N. Ellis, Wilmington, Del.; Ravi S. Sastry, King of Prussia, Pa.

[73] Assignee: Research and Trading Corporation, Wilmington, Del.

[21] Appl. No.: 130,862

[22] Filed: Oct. 4, 1993

[51] Int. Cl.[6] ..... A62B 1/00

[52] U.S. Cl. ..... 182/18; 182/3

[58] Field of Search ..... 182/18, 3; 116/212, 116/33, 34; 188/376, 371

[56] References Cited

U.S. PATENT DOCUMENTS

| | | | |
|---|---|---|---|
| 2,665,128 | 1/1954 | Guffey | 248/613 X |
| 2,679,228 | 5/1954 | Gryce . | |
| 2,933,324 | 4/1960 | Stimler | 182/3 X |
| 3,637,174 | 1/1972 | Kuo | 248/54 |
| 3,885,428 | 5/1975 | Dalferth | 73/143 |
| 4,058,079 | 11/1977 | Taylor et al. | 116/114 H |
| 4,102,295 | 7/1978 | Crook, Jr. et al. | 116/114 R |
| 4,217,849 | 8/1980 | Brown et al. | 116/212 |
| 4,253,544 | 3/1981 | Dalmaso | 182/3 |
| 4,457,251 | 7/1984 | Weman et al. | 116/212 |
| 4,964,491 | 10/1990 | Dombrowski et al. | 188/299 |
| 5,090,503 | 2/1992 | Bell | 182/5 |
| 5,143,187 | 9/1992 | McQuarrie et al. | 188/376 |
| 5,220,977 | 6/1993 | Wolner | 182/18 |

*Primary Examiner*—Alvin C. Chin-Shue
*Attorney, Agent, or Firm*—Breneman, Georges and Krikelis

[57] ABSTRACT

A shock load indicator for use with a safety cable comprising a casing surrounding a section of the cable, having severable top and bottom sections connected through a shearing means. The casing normally supports the weigth of the user of the cable, and encloses a length of the cable such that, when the cable is extended as a result of the severance of the casing due to a fall induced shock load, the top and bottom sections separate by a predetermined distance indicating that the cable has been subjected to a shock load.

5 Claims, 1 Drawing Sheet

SHOCK INDICATOR FOR USE ON SAFETY CABLES

BACKGROUND OF THE INVENTION

1. Field of the Invention

This invention relates to a safety indicator for use with safety cables, and more particularly to a shock load indicator for use with retracting life line devices 2. Description of Related Art Fall protection of workers, particularly in industrial environments, is accomplished with safety harnesses worn by the worker attached to a secure point through a lifeline, usually a steel cable or synthetic line.

Because the shock forces produced on an arresting line as a result of a human body falling even as small a distance as 6 ft. are quite, it is known practice to provide the lifeline with some form of retracting and/or frictional braking mechanism to limit the extend of free fall and the shock load to the line as the fall is arrested. A typical such system of line retraction and brake is sold by R.T.C. located in Wilmington Del., under the trademark RETRACTALOK®. Certain models are equipped with an indicator button which shows whether the unit has been used to arrest a fall so that it may be returned to the manufacturer for recertification. This button is spring loaded and is pushed outwardly by a lever when the arrestor operates to break a fall.

When a cable or rope lifeline is subjected to shock load, as from arresting a fall, it should be replaced since the load weakens the cable or rope making it unsafe for further use as a lifeline.

U.S. Pat. No. 5,090,503 shows a device which provides the frictional breaking action together with an indicator which shows whether the life line has been used to prevent a fall. This device is primarily for use on life lines comprised of rope rather than cable, and requires that the rope be folded over and clamped together; this arrangement provides the frictional force used to counteract the force due to the falling weight. However such folding over results in sharp bending and is not recommended for cables.

U.S. Pat. No. 5,143,187 shows an energy absorber and fall protection system which may be placed between a lifeline and its point of attachment. This device employs a series of breaking links which as they break allow a folded section of a chain interposed between the lifeline and the point of attachment thereof to extend, simultaneously cushioning the fall by absorbing energy and indicating by the chain elongation that a fall has occurred.

U.S. Pat. No. 5,220,977 also shows a fall indicator for use with life lines. As with the previous device, this indicator must also be placed between the lifeline and its attachment point to the person using such line, or between the lifeline and the anchoring point thereof. The structures shown in the above references are complex and relatively expensive. Interposing the indicators between the life line and its the point of attachment, introduces additional attachment points which are potential weak links any one of which may fail.

There is still need in the industry for a shock indicator which may be used on a lifeline, cable or rope, without weakening or otherwise compromising the holding power of the cable or rope itself, and which will reliably indicate whether the cable or rope has been subjected to shock loading as from a fall. The term cable will be used hereinafter in this descriprtion to indicate both rope and cable safety or life lines.

These and other objects of the present invention will be clear from the following description.

SUMMARY OF THE INVENTION

There is provided according to this invention a shock load indicator for use with a safety cable comprising:

a solid casing surrounding a first length of said cable, having severable top and bottom sections connected through a shearing means first means for attaching the cable at a first point on the top section of the casing, second means for attaching the cable at a second point on the bottom section of the casing, such that a second length of such safety cable extending between the first point and the second point is greater than the distance between such first and second points when said top and bottom sections are connected with the shearing means.

Preferably, the shock load indicator is tubular and made out of metal. The shearing means comprise a shearing pin extending through both the top and bottom sections and the bottom section may include a section bearing safety indicia, which is enclosed and hidden within the top section when the top and bottom section are connected with the shearing means, and which becomes visible when the pin shears and the top and bottom section separate.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
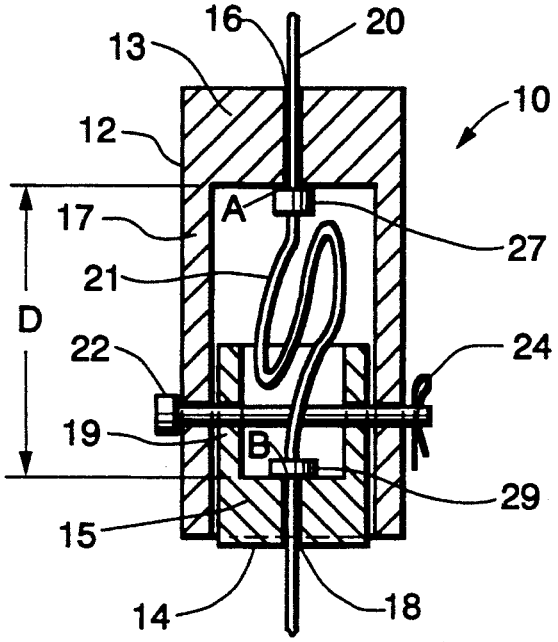
FIG. 1 is a schematic cross section representation of an indicator build in accordance with the present invention, showing the indicator mounted on a lifeline cable.

Throughout the following detailed description, similar reference characters refer to similar elements in all Figures of the drawings.

Referring now to FIG. 1 there is shown in schematic cross section an shock load indicator 10 built in accordance with this invention. The indicator comprises a hollow top section 12 and a hollow bottom section 14, the bottom section sized so that at least a portion thereof fits within the top section. A hole 16 extends through the upper part 13 of the top section and another hole 18 extends through the lower part 15 of the bottom section. Preferably the two holes are aligned along a straight line.

A second hole 23 extends through the lower portion of wall 17 of the top section 12, and hole 25 extends through the upper portion of wall 19 of the bottom section 14. Holes 23 and 25 are drilled so that when the bottom section 14 is inserted to a desired point in the top section 12, the holes are aligned and a shearing means, such as a shearing pin 22 may be inserted there through to secure the two sections together. A cotter pin 24, may be used to prevent the accidental removal of shearing pin 22, as illustrated, or the shearing pin may be a spring pin which does not need external securing means to hold it in place.

Shearing pin 22 is selected so that it will shear when subjected to a predetermined load applied transversely to its axis. In applications where the indicator is to be used on lifelines for people, the preferred shearing force for the pin 22 is between 450 and 500 lbs. Since an unrestricted vertical fall of a human body over a distance of 6 ft may generate shock load forces as high as 6,000 lbs when the fall is arrested, the pin will shear whenever a fall occurs. Even when used with shock cushioning devices such as the aforementioned RETRACTALOCK® the shock load is sufficient to shear the pin 22.

Figure 4:
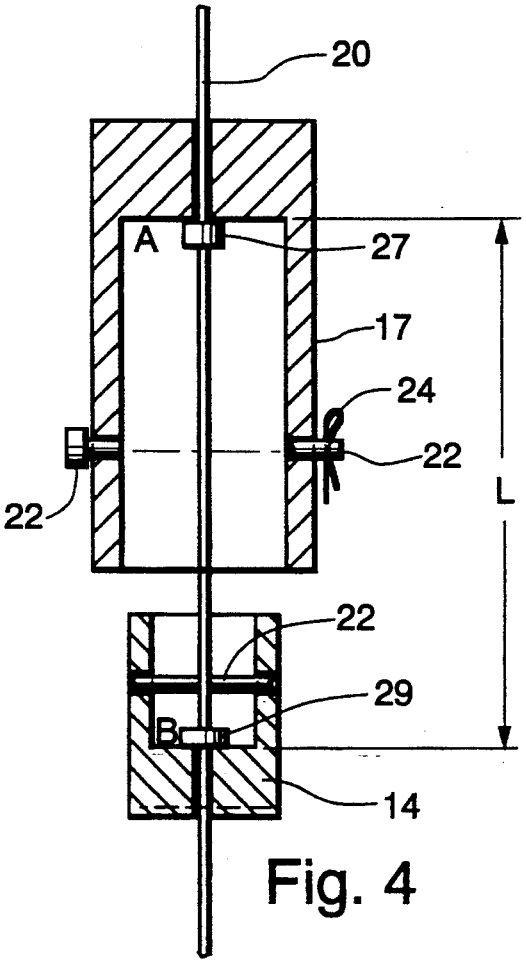
FIG. 4 shows in schematic cross section the indicator illustrated in FIG. 1 after it has been actuated through application of a load in excess of a predetermined limit.

The indicator is used on a cable 20 which extends through the indicator hollow areas of the top and bottom sections. The cable 20 has an attaching means 27, which may be a crimped on collar having a diameter larger than the hole 16 diameter, which prevents the cable from moving past a point "B" on the top section of the indicator when pulled up. The cable has a second attaching means, which again may be another crimped on collar 29 which prevents the cable from moving past point "B" on the bottom section when pulled in a downward direction as shown in FIG. 1. A length "L" of the cable 20 extending between points "A" and "B" as shown in FIG. 4, is selected longer than a distance "D", "D" being the distance between points "A" and "B" when the indicator is in its assembled, unactuated state, as shown in FIG. 1. Normally cable 20 between points "A" and "B" forms a small loop 22 that nestles within the hollow areas in the assembled indicator, and does not support any weight. The weight is transmitted by the collars 27 and 29 to the top and bottom sections 12 and 14 of the indicator.

Sections 12 and 14 are made of hard material such as metal, preferably aluminum, though other materials including plastics may be used. The selection of materials for the construction of the two sections is primarily a compromise between cost and ease of manufacture on one side and bulk on the other. The requirement is that each section should be able to sustain without deformation a force in excess of the force preselected for shearing the pin 22. This requirement is optimized in a preferred structure where the upper portion 13 of the top section 12 is much thicker than the wall portion 17, and where the lower portion 15 of the bottom section is thicker than the walls 19, to prevent the collar from cutting through the top or bottom, under load.

Figure 2:
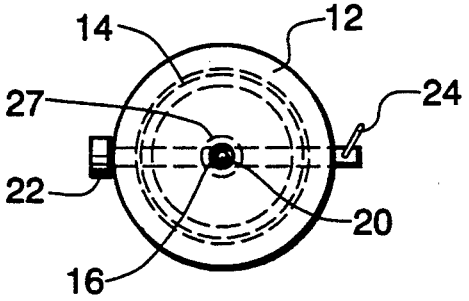
FIG. 2 is a schematic representation of a top view of one embodiment of the present invention.
Figure 3:
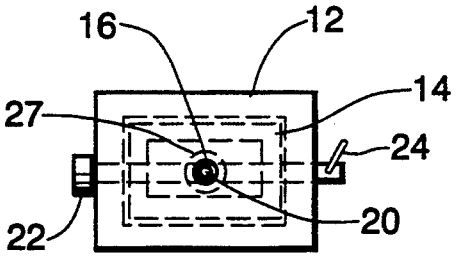
FIG. 3 is a schematic representation of a top view of another embodiment of the present invention.

The top and bottom sections may be cylindrical, as illustrated in FIG. 2 or any other convenient shape, such as rectangular when viewed from the top, as shown in FIG. 3.

Figure 5:
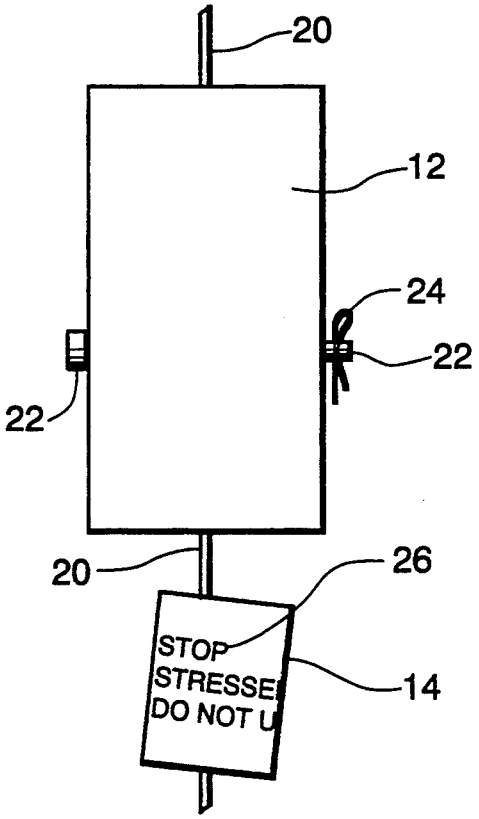
FIG. 5 shows the indicator of FIG. 4 in elevation view displaying optional indicia which become visible after actuation.

The bottom section wall 19 may bear indicia 26 shown in FIG. 5, which may convey any appropriate safety message regarding servicing or use of the safety cable 20 after it has been subjected to an excessive load. These indicia become visible after the indicator has been actuated and the top and bottom sections have severed.

In operation, the indicator is assembled on the cable 20 by crimping the two collars in position, where desired on the cable, spaced so that they are separated by a cable length "L" as defined above. The top and bottom sections are next inserted, by running the cable through holes 16 and 18, and the two sections are brought together, the bottom section entering in the top section. Holes 23 and 25 are aligned and pin 22 inserted and secured with the cotter pin, severally connecting the two sections.

In use, the working load is supported by the cable and the indicator, the load transferred from the cable to the indicator via collars 27 and 29. Pin 22 transfers the load from the bottom to the top section.

Should a fall occur, a large force, exceeding the design shearing force for the pin 22 is applied to the pin, severing the pin as illustrated in FIG. 4. The cable extends to its full length "L" between points "A" and "B", and takes up the load. Bottom section 14 now extends bellow top section 12 giving an immediate indication that a load in excess of the acceptable safe load has been applied to the cable, and that the cable and overall system should not be used without undergoing inspection. The shearing pin may then be replaced and the indicator used again.

Those skilled in the art having the benefit of the teachings of the present invention as hereinabove set forth, can effect numerous modifications thereto. These modifications are to be construed as being encompassed within the scope of the present invention as set forth in the appended claims.

We claim:

1. A shock load indicator for use with a safety cable comprising:

a solid casing surrounding a portion of said cable, having severable top and bottom sections connected through a shearing means, the safety cable extending uninterrupted through said casing first means for attaching the cable at a first point on the top section of the casing, second means for attaching the cable at a second point on the bottom section of the casing, such that the portion of such safety cable surrounded by the casing extending between the first point and the second point is greater than the distance between such first and second points when said top and bottom sections are connected with the shearing means.

2. The shock load indicator according to claim 1 wherein the solid casing is a metal casing.

3. The shock load indicator according to claim 2 wherein the casing has a circular cross section.

4. The shock load indicator according to claim 3 wherein the shearing means comprise a shearing pin extending through both the top and bottom sections, and the shearing pin is selected to shear under a break force of about 450 lbs to 500 lbs.

5. The shock load indicator according to claim 5 wherein the bottom section includes a section bearing safety indicia, which is enclosed and hidden within the top section when the top and bottom section are connected with the shearing means, and which becomes visible when the pin shears and the top and bottom section separate.

* * * * *